US008104410B2

(12) United States Patent
Lanfear et al.

(10) Patent No.: US 8,104,410 B2
(45) Date of Patent: Jan. 31, 2012

(54) RECONFIGURABLE DESK WITH INVERTIBLE WORKING SURFACE

(75) Inventors: Robert B. Lanfear, Hansville, WA (US); Daniel A. Novak, Suquamish, WA (US); Jacob Anthony Baron-Taltre, Kenmore, WA (US)

(73) Assignee: Watson Furniture Group, Inc., Poulsbo, WA (US)

( * ) Notice: Subject to any disclaimer, the term of this patent is extended or adjusted under 35 U.S.C. 154(b) by 227 days.

(21) Appl. No.: 12/626,341

(22) Filed: Nov. 25, 2009

(65) Prior Publication Data

US 2010/0126392 A1 May 27, 2010

Related U.S. Application Data

(60) Provisional application No. 61/118,367, filed on Nov. 26, 2008.

(51) Int. Cl.
*A47B 85/00* (2006.01)

(52) U.S. Cl. ..... 108/13; 108/147; 108/157.1

(58) Field of Classification Search ..... 108/11, 108/12, 50.01, 50.02, 147, 147.19, 157.1, 108/158, 13, 153.1
See application file for complete search history.

(56) References Cited

U.S. PATENT DOCUMENTS

| | | | | | |
|---|---|---|---|---|---|
| 2,757,996 | A | * | 8/1956 | Kozelka | 108/13 |
| 2,903,312 | A | * | 9/1959 | Lawless | 108/13 |
| 4,026,219 | A | * | 5/1977 | Shupe et al. | 108/13 |
| 4,651,652 | A | | 3/1987 | Wyckoff | |
| 5,289,782 | A | | 3/1994 | Rizzi | |
| 5,601,037 | A | * | 2/1997 | Meyer et al. | 108/147 |
| 5,890,438 | A | * | 4/1999 | Frankish | 108/147 |
| 6,024,025 | A | * | 2/2000 | Koch et al. | 108/147 |
| 6,119,605 | A | | 9/2000 | Agee | |
| 6,148,741 | A | * | 11/2000 | Motta | 108/147 |
| 6,283,422 | B1 | | 9/2001 | Stoelinga | |
| 6,286,441 | B1 | * | 9/2001 | Burdi et al. | 108/147 |
| 6,289,825 | B1 | | 9/2001 | Long | |
| 6,412,427 | B1 | | 7/2002 | Merkt | |
| 6,474,246 | B2 | * | 11/2002 | Hsu | 108/147 |
| 6,484,648 | B1 | | 11/2002 | Long | |
| 6,516,731 | B1 | * | 2/2003 | Park | 108/13 |
| 6,546,880 | B2 | | 4/2003 | Agee | |
| 6,769,369 | B1 | | 8/2004 | Brandenberg | |
| 6,935,250 | B1 | * | 8/2005 | Arnold | 108/147 |
| 7,412,931 | B2 | | 8/2008 | Seidl | |
| 7,487,690 | B2 | * | 2/2009 | Liu | 108/147 |
| 2002/0189505 | A1 | * | 12/2002 | Markofer | 108/50.01 |
| 2009/0072101 | A1 | | 3/2009 | Stoelinga | |

* cited by examiner

*Primary Examiner* — Jose V Chen
(74) *Attorney, Agent, or Firm* — Christensen O'Connor Johnson Kindness PLLC

(57) ABSTRACT

A desk having a reversible work platform. In one embodiment, the reversible work platform is attached to a frame assembly with a plurality of bushings and associated bolts, and can be reconfigured from a left-handed configuration to a right-handed configuration by removing the bushings and bolts from above the desk, flipping the reversible work platform, and reinstalling the bushings and bolts from above the desk. In one embodiment, an L-shaped desk is reconfigured by flipping the reversible work platform and rearranging the parts of the frame assembly. Leg assemblies of the frame assembly include height adjustment mechanisms, which are actuated by a hand crank to change the height of the reversible work platform.

19 Claims, 9 Drawing Sheets

RECONFIGURABLE DESK WITH INVERTIBLE WORKING SURFACE

CROSS-REFERENCE TO RELATED APPLICATION

This application claims the benefit of U.S. Provisional Application No. 61/118,367, filed Nov. 26, 2008, which is incorporated herein by reference in its entirety.

BACKGROUND

Large commercial organizations typically rely on an army of white collar workers to perform various business tasks that are critical to the successful operation of the business. For example, engineering and other professional services, day-to-day administrative and executive tasks, customer support functions, and sales and marketing and sales activities. Generally most or all of these workers require a workstation including a desk.

Larger organizations will typically maintain an inventory of extra desks to accommodate the changing workforce needs of the organization. The cost of carrying and storing extra desk inventory can be significant. Often, desks are asymmetrical, with different versions to accommodate left and right handed facility layouts and/or left and right handed users. For example, the available space layout in a facility may require or be more efficiently accommodated with different desk arrangements. Additional inventory of extra desks is required to accommodate both left and right handed users.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An embodiment of a desk includes a frame assembly, a reversible work platform, a plurality of bushings, and a plurality of bolts. The frame assembly includes a plurality of leg assemblies interconnected with a first platform support rail. Each leg assembly comprises a telescoping upright member and a second platform support rail, the second platform support rail including a threaded aperture. The reversible work platform has oppositely disposed first and second work surfaces, and a plurality of attachment apertures extending therethrough. The bushings of the plurality of bushings each have a flange portion and a tubular portion sized to slidably engage one of the plurality of attachment apertures. The bolts of the plurality of bolts are each sized to extend through the plurality of bushings and threadably engage the second platform support rail threaded apertures to attach the reversible work platform to the frame assembly. The plurality of attachment apertures are positioned to be alignable with the second platform support rail threaded apertures when the work platform is oriented with the first surface adjacent to the second platform support rails, and to also be alignable with the second platform support rail apertures when the work platform is oriented with the second surface adjacent the second platform support rails. The work platform is reversibly attachable to the frame assembly with the plurality of bolts that are accessible from above the frame assembly.

A method of assembling and reconfiguring a desk comprises providing a frame assembly comprising a plurality of leg assemblies connected with a first platform support rail, each leg assembly having a telescoping upright portion and a second platform support rail, the frame assembly having a plurality of threaded apertures; placing a work platform having oppositely disposed first and second work surfaces and a plurality of attachment apertures onto the frame assembly with the first work surface adjacent the second platform support rails and the plurality of attachment apertures aligned with the plurality of threaded apertures; inserting a plurality of bushings into the plurality of attachment apertures from above the work platform, each bushing having a tubular portion that extends into the attachment aperture and a flange that abuts the second work surface; inserting a plurality of bolts into the plurality of bushings such that the bolts threadably engage the frame assembly threaded apertures; reconfiguring the desk by removing the plurality of bolts and bushings, flipping the work platform over, placing the work platform on the frame assembly such that the second work surface is adjacent the second platform support rails, replacing the plurality of bushings in the attachment apertures from above the work platform such that the flanges of the bushings abut the first work surface, and inserting the plurality of bolts into the plurality of bushings such that the bolts threadably engage the frame assembly threaded apertures.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
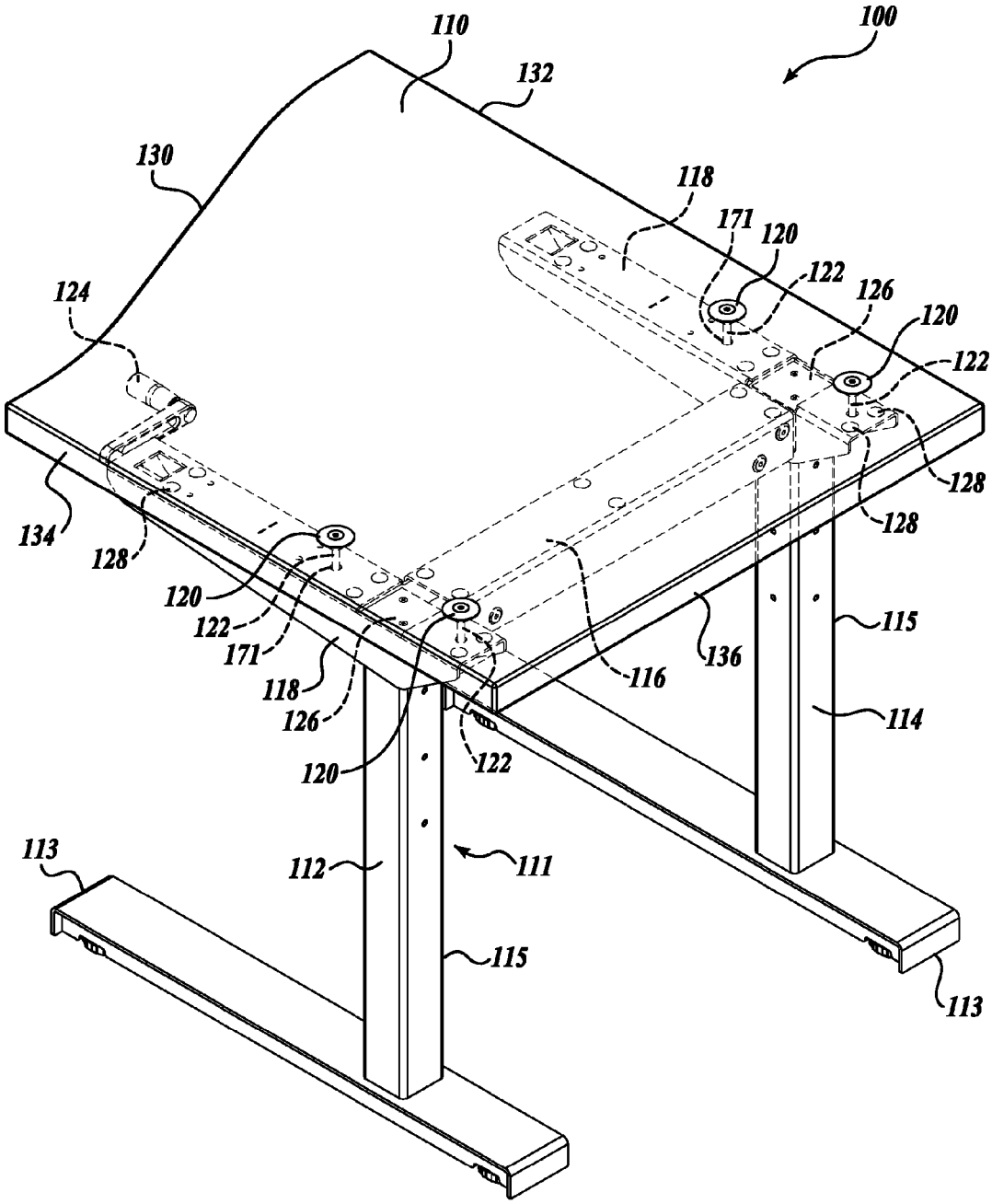
FIG. 1 is a perspective view of a first embodiment of a desk in accordance with the present invention, which portions of the frame assembly shown in phantom.

FIG. 1 illustrates an exemplary first embodiment of a desk 100 according to various aspects of the present disclosure. The desk 100 includes a reversible work platform 110 which rests upon a frame assembly 111.

The frame assembly 111 includes a first leg assembly 112 and a second leg assembly 114, which are connected by a first platform support rail 116. Each of the leg assemblies 112, 114 includes a foot portion 113, an upright portion 115, and a second platform support rail 118. The foot portion 113 includes appropriate floor-engaging hardware, such as adjustable feet, wheels, casters, pads, and the like. The frame assembly 111 can be formed from any suitable material. In an exemplary embodiment, the frame assembly 111 is formed from metal, but other materials such as wood, plastic, or combinations thereof can also be used. If not otherwise described herein, the portions of frame assembly 111 are attached to each other via any suitable method, such as cementing, brazing, welding, fastening, and the like.

The upright portion 115 includes a telescoping member that allows the height of the reversible work platform 110 to be changed. A height adjustment mechanism 126 is present within the leg assemblies 112, 114, and is actuated with an associated crank assembly 124. In other embodiments, the upright portion 115 comprises a single member of a fixed height.

The reversible work platform 110 rests on top of the frame assembly 111, and has a curved front edge 130, a left edge 132, a right edge 134, and a back edge 136. In the illustrated configuration, a first surface of the reversible work platform 110 is facing up to provide a work surface, and a second surface of the reversible work platform 110 is facing down and is adjacent to the frame assembly 111. The reversible work platform 110 is attached to the frame assembly 111 by a plurality of bolts 122, which pass through corresponding bushings 120 disposed in work platform attachment apertures to engage threaded apertures 171 in the second platform support rails 118. These features will be described in further detail below.

Both the first surface and the second surface of the reversible work platform 110 are finished so as to be appropriate to be arranged as the upward-facing surface, and therefore allow the reversible work platform 110 to be flipped over to change the configuration of the desk 100. For example, the first surface and the second surface may be finished with the same material. In another example, the first surface may be finished with a first design, pattern, material, or color, and the second surface may be finished with a different design, pattern, material, or color, so that flipping the reversible work platform 110 can provide a variety in appearance. The second platform support rails 118 include pads 128, so that the surface of the reversible work platform 110 in contact with the second platform support rails 118 is not marked or damaged.

The left edge 132 and right edge 134 meet the back edge 136 of the reversible work platform 110 at substantially square corners. The left edge 132 and right edge 134 are different lengths, however, which makes the curved front edge 130 extend further from the frame assembly 111 at the left edge 132 than at the right edge 134. One can recognize that this configuration would be suitable for a left-handed user of the desk 100, as the extension of the curved front edge 130 can be used by a person sitting at the desk 100 to rest his arm while writing. When the reversible work platform 110 is flipped over to place the desk 100 in a second configuration (as indicated by arrow 90 in FIG. 2A), the extended portion of the curved front edge 130 serves as an extension suitable for a right-handed user of the desk 100. Hence, the first configuration can be referred to as a left-handed configuration, and the second configuration can be referred to as a right-handed configuration. Other shapes of the reversible work platform 110 can be used, as well, which provide different configurations when flipped.

Figure 2A:
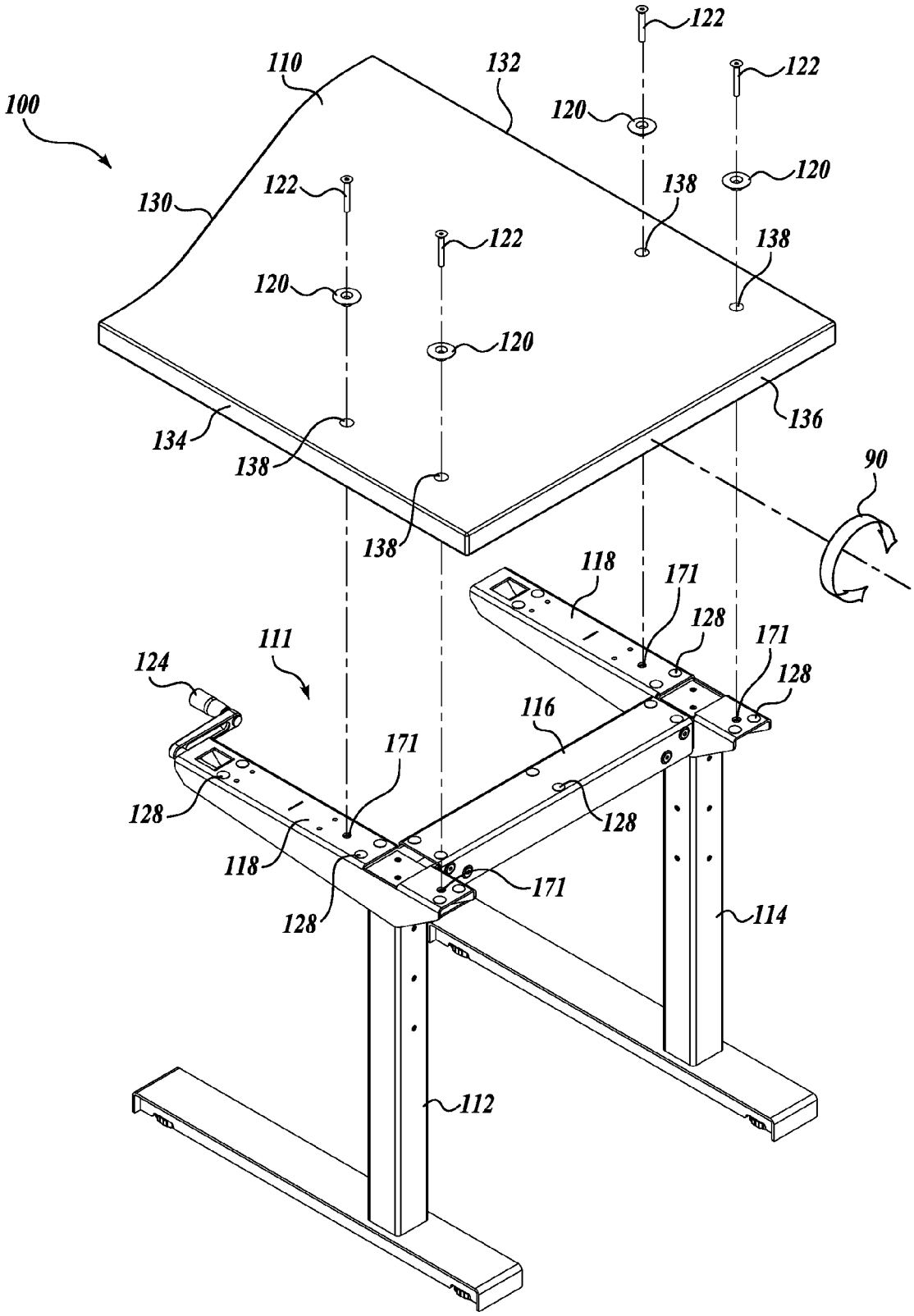
FIG. 2A illustrates a partially exploded view of the desk of FIG. 1, with the reversible work platform being lifted away from the frame.

FIG. 2A illustrates a partially exploded view of the embodiment of a desk 100 illustrated in FIG. 1. Reversible work platform 110 includes a plurality of attachment apertures 138. Attachment apertures 138 are sized to accommodate a plurality of bushings 120, which are in turn sized to accommodate a plurality of bolts 122. The attachment apertures 138 are symmetrically located on the reversible work platform 110 such that, whether the reversible work platform 110 is arranged with the first surface adjacent to the platform support rails 116, 118 or with the second surface adjacent to the platform support rails 116, 118, the attachment apertures 138 can be aligned with threaded apertures 171 on the second platform support rails 118 of the leg assemblies 112, 114. The plurality of bolts 122 are then inserted into the bushings 120 in the attachment apertures 138 to threadably engage the threaded apertures 171 and secure the reversible work platform 110 to the frame assembly 111.

Figure 2B:
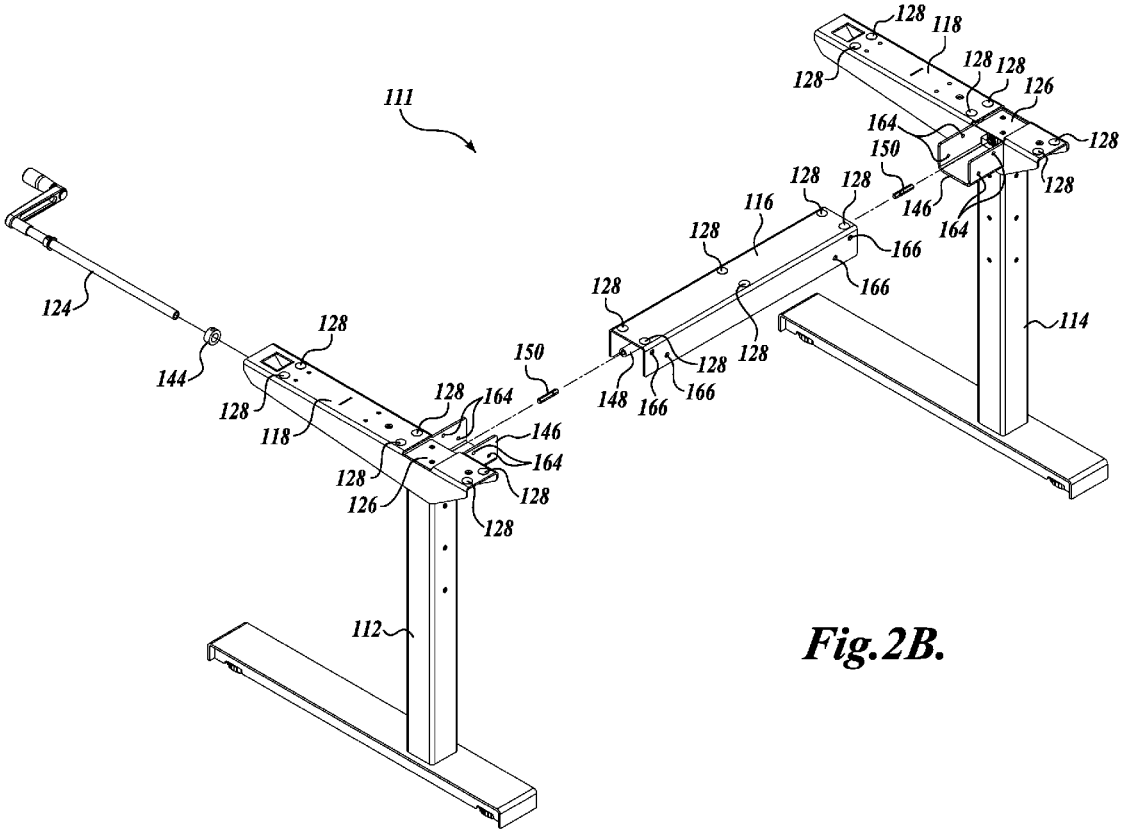
FIG. 2B illustrates a partially exploded view of the frame assembly of the desk of FIG. 1.

FIG. 2B illustrates a further partially exploded view of the frame assembly 111 to further illustrate the components. The height adjustment mechanism 126 of the leg assemblies 112, 114 may include a lead screw mechanism as is well-known in the art and is controlled via a crank assembly 124. Crank assembly 124 is slidably coupled to an actuator shaft 142 (see FIG. 5A), and is slidably retained in the associated second platform support rail 118 by a set collar 144. This assembly will be described further below.

In the illustrated embodiment, only one crank assembly 124 is used. The height adjustment mechanisms 126 in each of the first leg assembly 112 and the second leg assembly 114 are mechanically coupled by a drive shaft 148 extending between the first leg assembly 112 and the second leg assembly 114. The drive shaft 148 is coupled to the height adjustment mechanisms 126 by adaptors 150. The height adjustment mechanism 126 includes a gearbox 154, such that actuating the height adjustment mechanism 126 of the first leg assembly 112 (e.g. with crank assembly 124) causes the drive shaft 148 to actuate the height adjustment mechanism 126 of the second leg assembly 114. In the current embodiment the crank assembly 124 may be used and relocated from one actuator shaft 142 to another, and is positioned on the leg assembly nearest to the shorter edge 134 of the work platform 110. To change the height of the desk 100, the user pulls the crank assembly 124 forward so the crank clears the work platform front edge 130, and rotates the crank assembly 124.

The leg assemblies 112, 114 are interconnected by a first platform support rail 116. First platform support rail 116 rests on a shoulder 146 of each leg assembly 112, 114, such that apertures 166 of the first platform support rail 116 align with threaded apertures 164 of the shoulder 146. The first platform support rail 116 is held in place on the shoulder 146 by a plurality of hex screws (not shown) inserted through the apertures 166 and engaging the threaded apertures 164. In other embodiments, attachment hardware other than or in addition to hex screws may be used, or the first platform support rail 116 may otherwise lockingly engage the shoulders 146.

The illustrated first platform support rail 116 is an elongated, inverted U-shaped member. Other shapes and cross-sections of the first platform support rail 116 can be used, but this shape provides certain benefits in the minimization of construction material, and in ease of assembly. Also, additional rails can be used to further connect the first leg assembly 112 and the second leg assembly 114, and additional members such as privacy screens, drawers, cabinets, and the like, can be coupled to the leg assemblies 112, 114 or the first platform support rail 116.

Figure 3A:
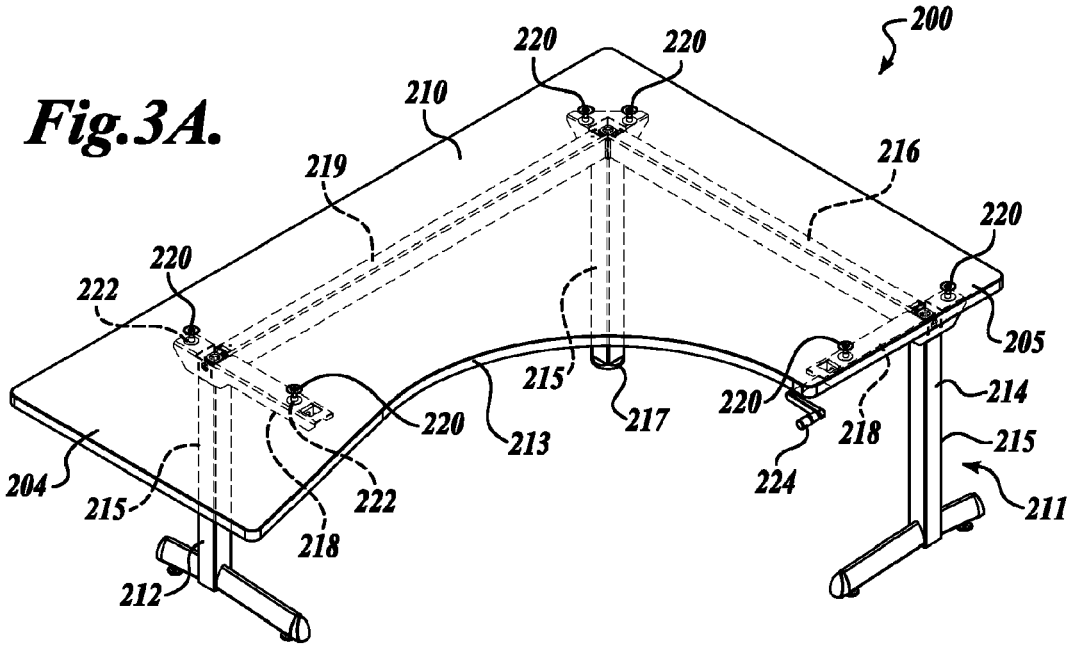
FIG. 3A is a perspective view of a second embodiment of a desk in a first configuration.

FIG. 3A illustrates an exemplary second embodiment of a desk 200 according to various embodiments of the present disclosure. This embodiment of a desk 200 is similar to the embodiment discussed above, in that a reversible work platform 210 rests on top of a frame assembly 211, and is attached to the frame assembly 211 by a plurality of bushings 220 and a plurality of bolts 222. Frame assembly 211 includes a first leg assembly 212 and a second leg assembly 214 similar to the leg assemblies 112, 114 described above, and a corner leg assembly 217. As with the previous embodiment, the first and second leg assemblies 212, 214 include a second surface support rail 218 having threaded apertures; a crank assembly 224 is attached to a height adjustment mechanism (not shown) in one of the leg assemblies 212.

The reversible work platform 210 of the desk 200 is generally L-shaped, with a long arm 204 and a short arm 205. A curved edge 213 is disposed at the front of the reversible work platform 210. The second leg assembly 214 is connected by a first platform support rail 216 to the corner leg assembly 217, which is in turn connected by a third platform support rail 219 to the first leg assembly 212. Corner leg assembly 217 includes an upright portion 215 similar to the upright portion 215 of the first leg assembly 212 and the second leg assembly 214.

In a first configuration illustrated in FIG. 3A, the long arm 204 extends to the left. This configuration can be referred to as a left-handed configuration. Similar to the previous embodiment, a drive shaft connects a height adjustment mechanism in the first leg assembly 212 to a height adjustment mechanism in the corner leg assembly 217, and another drive shaft connects the height adjustment mechanism in the corner leg assembly 217 to a height adjustment mechanism in the second leg assembly 214. The crank assembly 224 is coupled to an actuator shaft 142 (see FIG. 5A) of the first leg assembly 212, which can be used to actuate the height adjustment mechanisms in all of the leg assemblies at the same time.

Figure 3B:
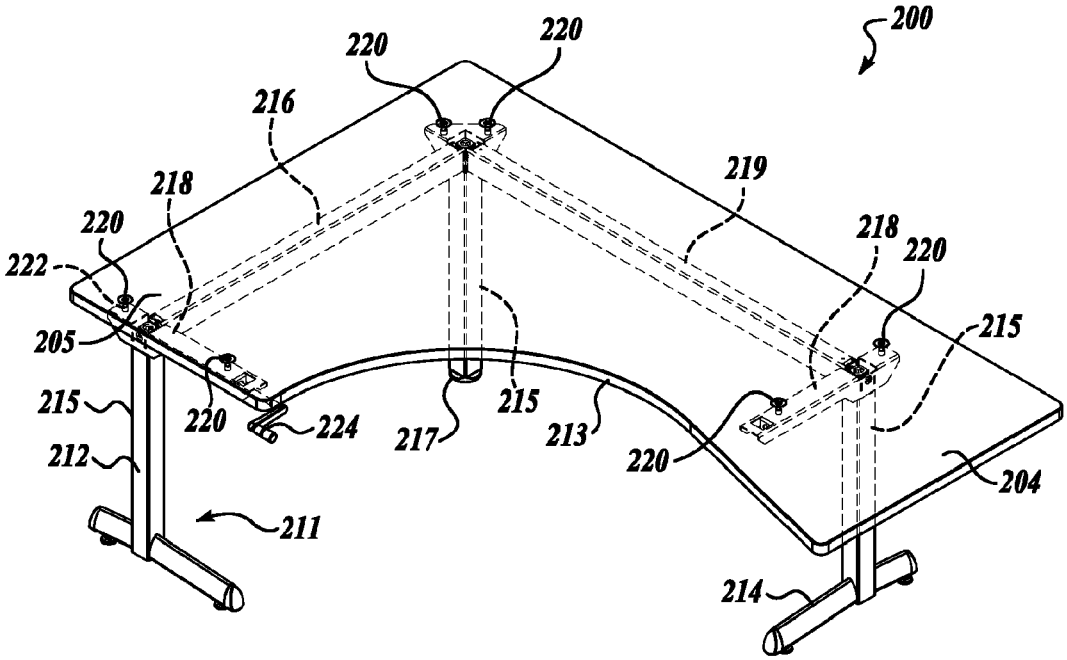
FIG. 3B is a perspective view of the desk of FIG. 3A, reassembled in a second configuration.

FIG. 3B illustrates the desk 200 of FIG. 3A in a second configuration. In this configuration, the reversible work platform 210 has been flipped over, such that the long arm 204 extends to the right. This configuration can, therefore, be referred to as a right-handed configuration. In the second configuration, the frame assembly 211 has also been reconfigured, such that the first platform support rail 216 now connects the first leg assembly 212 to the corner leg 217, and the third platform support rail 219 now connects the corner leg 217 to the second leg assembly 214. After reconfiguring the frame assembly 211 and flipping the reversible work platform 210, the attachment apertures of the reversible work platform 210 align with the threaded apertures of the frame assembly 211. The crank assembly 224 has also been moved from the first leg assembly 212 to the second leg assembly 214. Depending on the shape of the reversible work platform 210 and the preferences of the user, the crank assembly 224 may not have to be moved when the desk 200 is reconfigured.

Figure 4A:
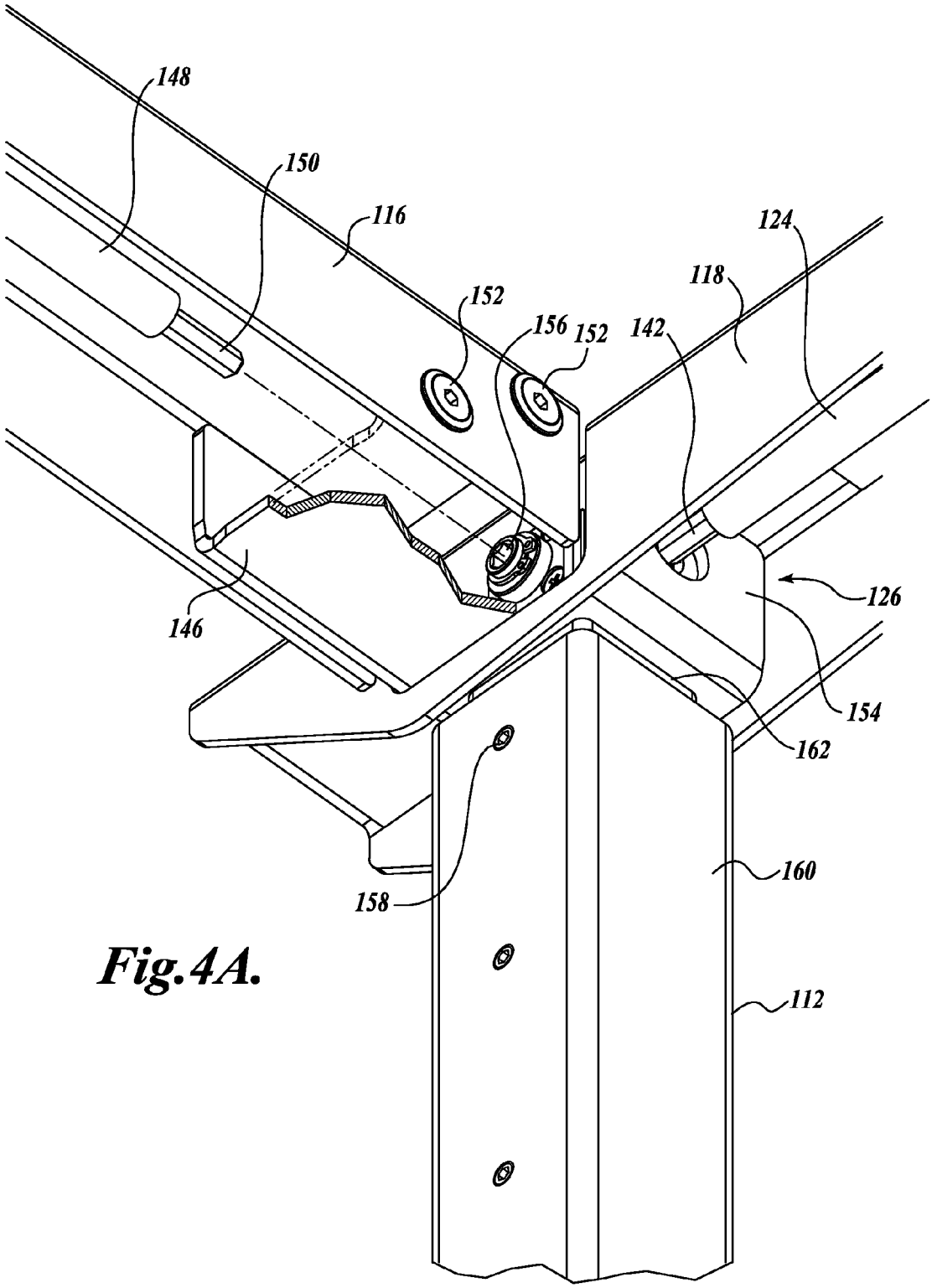
FIG. 4A is a detail view of a leg assembly and a first platform support rail of the desk illustrated in FIG. 1.

FIG. 4A shows a detail view of the connection between the second platform support rail 116 and the first leg assembly 112 of the desk 100 illustrated in FIG. 1. The second platform support rail 116 is attached to shoulder 146 by a pair of hex screws 152. A portion of the shoulder 146 is cut away to illustrate further details of the assembly that would otherwise be hidden.

The height adjustment mechanism 126 includes a gearbox 154. This gearbox 154 is actuated by the actuator shaft 142, and is connected to a jack screw (not pictured) or other similar mechanism within the upright portion 115 of the leg assembly 112. Actuating the gearbox 154 causes the first leg assembly 112 to telescope. The gearbox 154 sits atop an adjustment mechanism shaft 162, which is fixedly attached to an upper telescoping member 160 of the leg assembly 112 by an anchor screw 158. Upper telescoping member 160 is slidably disposed within lower telescoping member 174 (see FIG. 6). Actuating gearbox 154 also causes socket 156 to rotate. The drive shaft 148 (shown in exploded view) is coupled to the socket 156 by adaptor 150. The drive shaft 148 is connected to the height adjustment mechanism 126 in the second leg assembly 114 (see FIG. 1) to transfer the actuating force from the gearbox 154 and thereby adjust the height of multiple leg assemblies at once. Since the shoulder 146 is in the form of a U-shaped member, and the first platform support rail 116 is in the form of an inverted U-shaped member, the drive shaft 148 may be inserted into the socket 156 from below the first platform support rail 116 after the first platform support rail is attached to the shoulder 146.

Figure 4B:
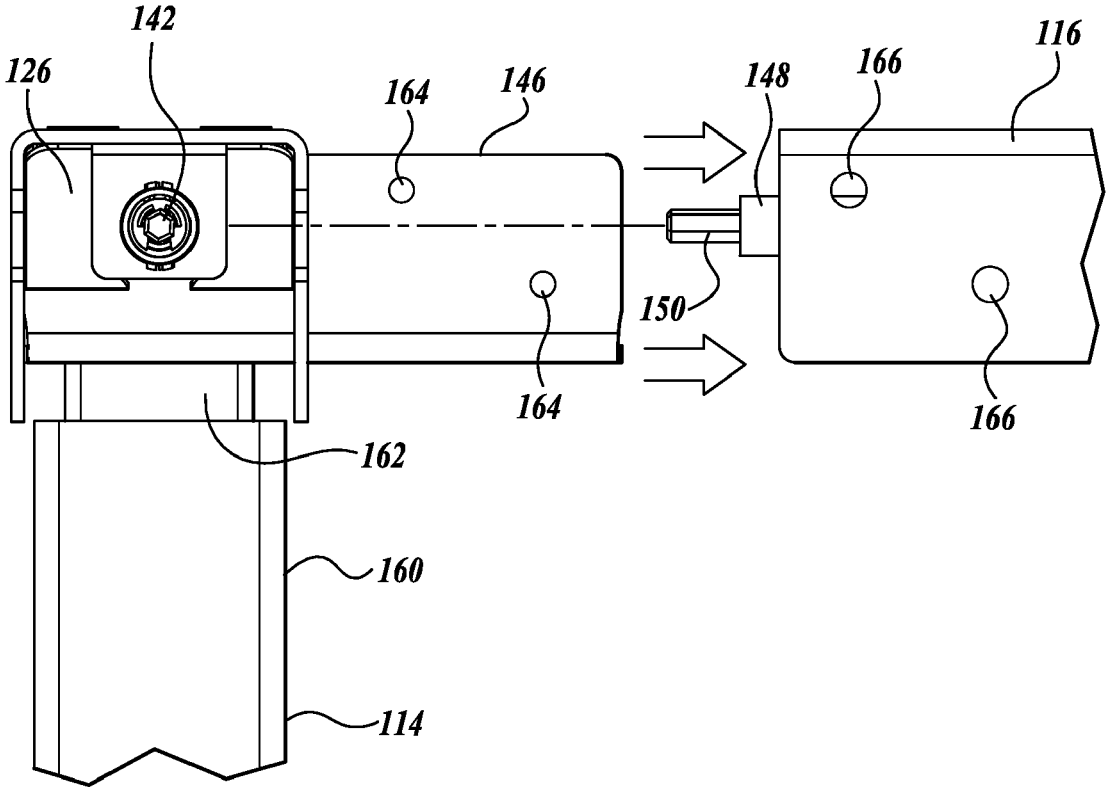
FIG. 4B is a detail view of another leg assembly, along with the first platform support rail illustrated in FIG. 4A.

FIG. 4B shows a detail end view of the connection between the second platform support rail 116 and the second leg assembly 114 of the desk 100 illustrated in FIG. 1. FIG. 4B assumes that the drive shaft 148 and first platform support rail 116 have already been coupled to the first leg assembly 112 as shown in FIG. 4A. The second leg assembly 114 may be brought horizontally to engage the drive shaft 148 and the first platform support rail 116, such that the adaptor 150 of the drive shaft engages a socket (not shown) of the height adjustment mechanism 126 of the second leg assembly 114 and the apertures 116 of the first platform support rail 116 align with the threaded apertures 164 of the shoulder 146 of the second leg assembly 114.

Figure 5A:
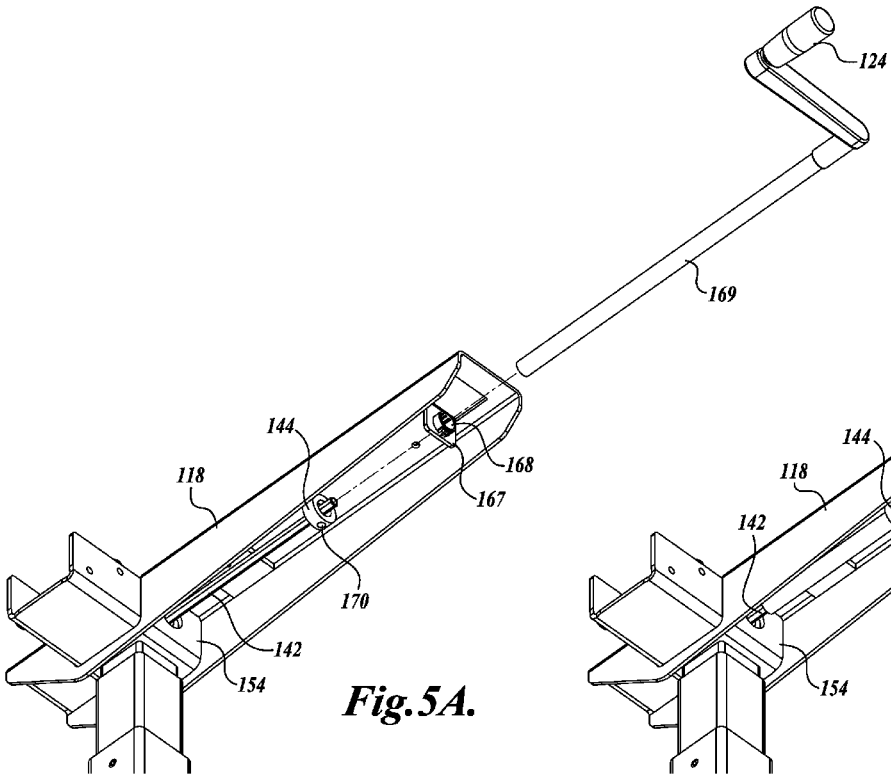
FIG. 5A is a detail view of a crank assembly before being placed over an actuator shaft of the desk illustrated in FIG. 1.

FIG. 5A illustrates a detail view of the underside of the second platform support rail 118 of the leg assembly 112 showing the crank assembly 124 before being attached to the actuator shaft 142. A crank guide 168 is aligned to guide the crank shaft 169 of the crank assembly 124 onto the actuator shaft 142. The crank guide 168 is formed within a tab 167 created by folding down a portion of the second platform support rail 118. In other embodiments, the tab 167 can be a separate piece that is fixedly attached to the underside of the second platform support rail 118. Once the crank shaft 169 passes through the crank guide 168, the set collar 144 is passed over the crank shaft 169. The crank shaft 169 drivably engages the actuator shaft 142. The set collar 144 is positioned to allow the crank assembly 124 to be slidably pulled out a distance without disengaging the actuator shaft 142.

Figure 5B:
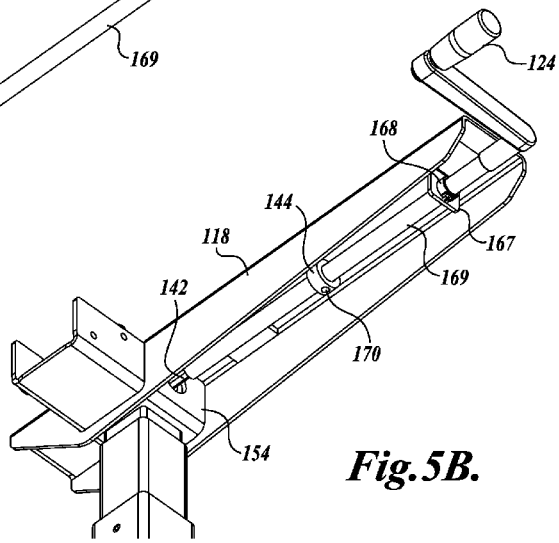
FIG. 5B is a detail view of the crank assembly after being placed over the actuator shaft of the desk illustrated in FIG. 1.

FIG. 5B illustrates the crank assembly 124 fully installed. The set screw 170 holds the set collar 144 in place on the crank shaft 169. The crank shaft 169 is allowed to move axially along the actuator shaft 142, until the crank shaft comes into contact with the gearbox 154, or until the set collar 144 comes in contact with the tab 167. This allows the crank assembly 124 to be extended and retracted, such as to extend the crank past the edge of the reversible work platform 110 while operating the crank, and to retract the crank under the edge of the reversible work platform 110 for storage while not operating the crank.

Figure 6:
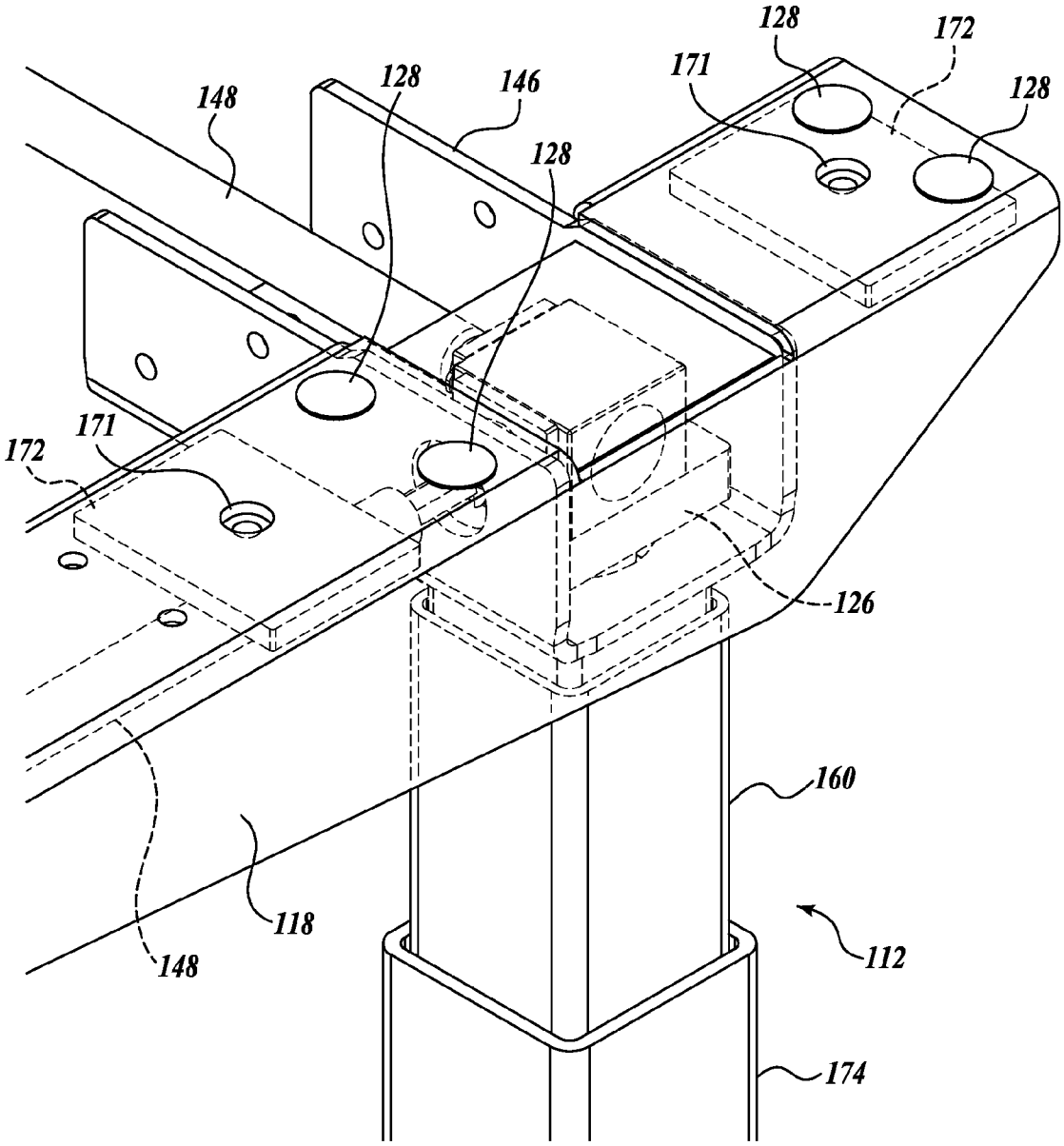
FIG. 6 is a detail view of a leg assembly of the desk illustrated in FIG. 1, with certain parts shown in phantom and shown in a partially telescoped configuration.

FIG. 6 illustrates a detail view of an assembled upper portion of the first leg assembly 112 of the desk 100 illustrated in FIG. 1, with certain hidden components shown in phantom and other elements removed, for clarity. In this illustration, the height adjustment mechanism 126 has been used to telescope the upper telescoping member 160 above the lower telescoping member 174 to a further degree than in the other illustrations. A plurality of pads 128 are arranged about the second platform support rail 118. As discussed above, the pads 128 protect the surface of the reversible work platform 110 that is in contact with the second platform support rail 118 from being damaged. The pads 128 may be made from any suitable cushioning material, such as felt, plastic, rubber, and the like. The pads 128 are attached to the second platform support rail 118 in any suitable manner, such as by adhesive, or via a mechanical fastener located underneath the pads 128.

Also illustrated is a pair of apertures 171. These apertures 171 accept the bolts 122 when the desk 100 is assembled. The bolts 122 pass through the apertures 171 to engage a threaded aperture in a nut plate 172. The nut plates 172 can be attached to the underside of the second platform support rail 118 by any suitable method, such as welding, brazing, adhesive, and the like. In another embodiment, nut plates 172 are not present, and the apertures 171 in the second platform support rail 118 themselves are threaded to engage the bolts 122. In embodiments using nut plates 172, benefits such as durability and reparability can be obtained.

Figure 7:
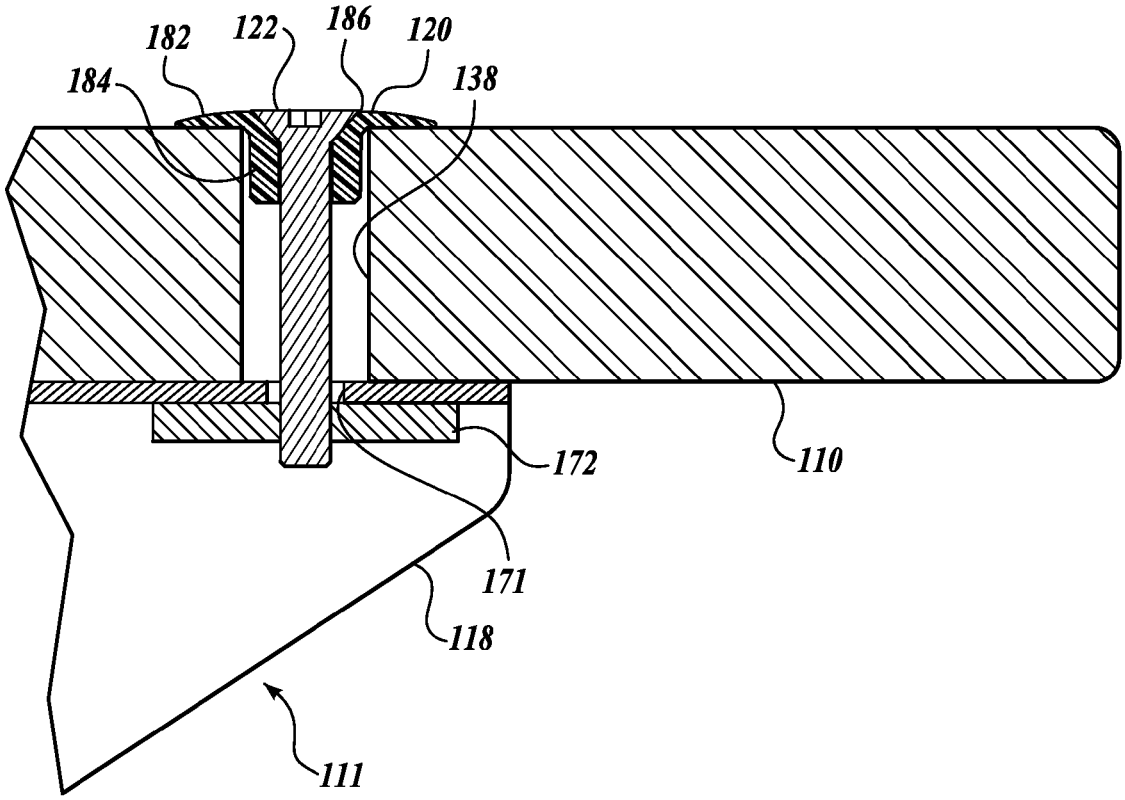
FIG. 7 is a cross-sectional detail of the desk illustrated in FIG. 1, showing an attachment aperture and the associated connection hardware.

FIG. 7 illustrates a cross-sectional detail view of a portion of the assembled reversible work platform 110 and frame assembly 111 of FIG. 1. A bushing 120 is inserted into an attachment aperture 138 of the reversible work platform 110. The bushing 120 includes a flange 182 that abuts the reversible work platform 110, and a tubular portion 184 that is inserted into the attachment aperture 138. In one embodiment, the tubular portion 184 has an external diameter sized to provide a friction fit between the bushing 120 and the attachment aperture 138. In another embodiment, the tubular portion 184 has an external diameter sized to fit loosely within the attachment aperture 138, to ease the insertion and removal of the bushing 120. As shown, the bushing 120 has a beveled top surface 186, and a countersunk hole to accommodate the bolt 122 flush with the beveled top surface 186.

The bolt 122 is inserted into the bushing 120, through the attachment aperture 138 of the reversible work platform 110, and through the aperture 171 of the second platform support rail 118 to engage the threaded aperture of the nut plate 172. The bolt 122 holds the bushing 120 in contact with the reversible work platform 110, and thereby fastens the reversible work platform 110 to the second platform support rail 118. The bushing 120 and the bolt 122 are both installed from the top of the desk 100. Even when the reversible work platform 110 is flipped over, the bushing 120 and the bolt 122 are still both installed from the top of the desk 100. This provides many benefits, including ease of assembly and reconfiguration, speed of assembly and reconfiguration, and reduction in the number of tools required for assembly and reconfiguration.

Assembling and reconfiguring a desk 100 such as the one illustrated in FIG. 1 is made easier due to the design of the desk 100. The shoulder 146 of the first leg assembly 112 is attached to the first platform support rail 116 via the hex screws 152. An adaptor 150 is placed on one end of a drive shaft 148, which is then coupled to the socket 156 of the height adjustment mechanism 126 of the first leg assembly 112. The drive shaft 148 may be guided into the cavity formed by the first platform support rail 116 and the shoulder 146 from the open side of the first platform support rail 116, for instance, by angling the drive shaft 148.

Next, the drive shaft 148 is held substantially parallel to the first platform support rail 116, and the shoulder 146 of the second leg assembly 114 is guided horizontally to engage the drive shaft 148 and the first platform support rail 116. The second leg assembly 114 is then attached to the first platform support rail 116 via additional hex screws 152. At this point, the frame assembly 111 has been assembled.

Next, the reversible work platform 110 is installed. The attachment apertures 138 of the reversible work platform 110 are aligned with the apertures 171 of the frame assembly 111. The pads 128 allow the reversible work platform 110 to slide along the frame assembly 111 during such alignment, and protect the reversible work platform 110 from damage in doing so. Once aligned, the plurality of bushings 120 are inserted into the attachment apertures 138 from the top of the desk 100. The plurality of bolts 122 are inserted into the plurality of bushings 120, also from the top of the desk 100, to pass through the attachment apertures 138 and the apertures 171 to engage the nut plates 172. Finally, the crank assembly 124 is attached to an actuator shaft 142, as described in further detail above.

To reconfigure the desk 100 of FIG. 1 after assembly, first the plurality of bolts 122 are removed. Next, the plurality of bushings 120 are removed. Each of these actions may be performed from the top side of the desk 100. If the bushings 120 have only a loose fit, then they can be removed from the attachment apertures 138 by hand. However, if the fit between the tubular portion 184 of the bushings 120 and the attachment apertures 138 is tighter, a hooked tool or an ejector pin may be required to retrieve the bushings 120 from the attachment apertures 138.

The reversible work platform 110, being freed from the frame assembly 111, is flipped over, such that the surface that had been adjacent to the frame assembly 111 is now facing up. The attachment apertures 138 of the reversible work platform 110 are again aligned with the apertures 171 of the frame assembly 111. The bushings 120 are inserted into the attachment apertures 138 and the bolts 122 are inserted into the bushings 120 to engage the nut plates 172. The bushings 120 and bolts 122 are again insertable from the top of the desk 100, despite the fact that the reversible work platform 110 has been flipped. Finally, the crank assembly 124 can be moved from the first leg assembly 112 to the second leg assembly 114, if desired.

Assembling a more complicated desk, such as the three-legged desk 200 illustrated in FIGS. 3A and 3B, is largely similar to the assembly and reconfiguring of the previous desk 100. However, to assemble the frame assembly 111, additional steps must be performed. Instead of connecting the first platform support rail 116 and drive shaft 148 directly from a first leg assembly 112 to a second leg assembly 114, the first platform support rail 216 and drive shaft (not pictured) connect the second leg assembly 214 to the corner leg assembly 217. Then, the third platform support rail 219 is used to connect the corner leg assembly 217 to the first leg assembly 212. Otherwise, the method of connecting the leg assemblies and platform support rails to form the frame assembly is substantially similar to the method described above.

Reconfiguring a three-legged desk 200 is also slightly more complicated. Whereas the two-legged desk 100 did not require a reconfiguration of the frame assembly 111 when flipping the reversible work platform 110, the highly asymmetrical nature of the reversible work platform 210 illustrated in FIGS. 3A and 3B requires such a reconfiguration. In addition to flipping the top of the reversible work platform 210, the first platform support rail 216, the third platform support rail 219, and the respective drive shafts (not shown) must be swapped. The hex nuts holding the support rails to the leg assemblies are removed, as are the drive shafts. The corner leg assembly 217 is repositioned to an appropriate location. Finally, the platform support rails and drive shafts are swapped and reconnected to the leg assemblies, as described above.

It will be appreciated that although the above description refers to right-hand and left-hand configurations, the utilization of an asymmetric working surface mounted on a support structure, wherein the asymmetric working surface may be flipped over and reattached adds great flexibility in the use of the furniture, that may be applied in situations other than alternatively accommodating left and right handed users. For example, the reconfigurable working surfaces may be adapted to better accommodate a particular work space, or to enable more useful combinations of working surfaces.

While the preferred embodiment of the invention has been illustrated and described, it will be appreciated that various changes can be made therein without departing from the spirit and scope of the invention. For example, it is contemplated that the working surface 110 may be adapted to receive removable storage containers or a slidably extending portion, for example to accommodate a keyboard. Similarly, apertures may be provided, for example to accommodate lighting fixtures, cords, or the like. In another embodiment, the support frame may incorporate outlets, such as electrical, phone or data jacks. In other embodiments, optional elements may be incorporated into the desk, such as privacy screens, modesty panels, or the like.

The embodiments of the invention in which an exclusive property or privilege is claimed are defined as follows:

1. A desk, comprising:

a frame assembly including a plurality of leg assemblies interconnected with a first platform support rail, each leg assembly comprising a telescoping upright member and a second platform support rail, wherein the second platform support rail includes a threaded aperture;

a reversible work platform having oppositely disposed first and second work surfaces, and a plurality of attachment apertures extending therethrough;

a plurality of bushings having a flange portion and a tubular portion sized to slidably engage one of the plurality of attachment apertures wherein the bushings are sized and configured to be removably inserted into the attachment aperture of the reversible work platform from either the first or the second work surface; and a plurality of bolts sized to extend through the plurality of bushings and threadably engage the second platform support rail threaded apertures to attach the reversible work platform to the frame assembly;

wherein the plurality of attachment apertures are positioned to be alignable with the second platform support rail threaded apertures when the work platform is oriented with the first work surffice adjacent to the second platform support rails, and to also be alignable with the second platform support rail threaded apertures when the work platform is oriented with the second work surface adjacent the second platform support rails;

whereby the reversible work platform is attachable to the frame assembly with the plurality of bolts that are accessible from above the frame assembly, and wherein the reversible work platform is asymmetric such that the desk has a left-handed orientation when the first work surface is oriented adjacent to the second platform support rails, and the desk has a reversed right-handed orientation when the second work surface is oriented adjacent to the second platform support rails.

2. The desk of claim 1, wherein the flange portion of each bushing is beveled.

3. The desk of claim 1, wherein the first work surface and the second work surface of the reversible work platform are similarly finished.

4. The desk of claim 1, wherein each of the plurality of leg assemblies includes a height-changing mechanism and further wherein the height-changing mechanism of each leg assembly is drivably coupled to the height-changing mechanisms of the other leg assemblies with at least one drive shaft.

5. The desk of claim 4, wherein at least one of the plurality of leg assemblies includes an actuator shaft that drivably engages the at least one drive shaft.

6. The desk of claim 5, further comprising a hand crank, wherein the actuator shaft is releasably coupleable to the hand crank.

7. The desk of claim 6, further comprising a set collar adapted to retain the hand crank on the actuator shaft.

8. The desk of claim 1, wherein the plurality of leg assemblies includes a left leg assembly and a right leg assembly that is substantially a mirror image of the left leg assembly.

9. The desk of claim 8, wherein the plurality of leg assemblies further includes a corner leg assembly.

10. The desk of claim 9, wherein the first platform support rail interconnects the left leg assembly with the corner leg assembly, and wherein the frame assembly further includes a third platform support rail interconnecting the corner leg assembly with the right leg assembly.

11. The desk of claim 10, wherein the first platform support rail has a different length than the third platform support rail.

12. A method of assembling and reconfiguring a desk, comprising:

providing a frame assembly comprising a plurality of leg assemblies connected with a first platform support rail, each leg assembly having a telescoping upright portion and a second platform support rail, the frame assembly having a plurality of threaded apertures;

placing a work platform having oppositely disposed first and second work surfaces and a plurality of attachment apertures onto the frame assembly with the first work surface adjacent the second platform support rails and the plurality of attachment apertures aliened with the plurality of threaded apertures;

inserting a plurality of bushings into the plurality of attachment apertures from above the work platform, each bushing having a tubular portion that extends into the attachment aperture and a flange that abuts the second work surface;

inserting a plurality of bolts into the plurality of bushings such that the bolts threadably engage the frame assembly threaded apertures;

reconfiguring the desk by removing the plurality of bolts and bushings, flipping the work platform over, placing the work platform on the frame assembly such that the second work surface is adjacent the second platform support rails, placing the plurality of bushings in the attachment apertures from above the work platform such that the flanges of the bushings abut the first work surface, and inserting the plurality of bolts into the plurality of bushings such that the bolts threadably engage the frame assembly threaded apertures, and wherein the reversible work platform is asymmetric such that the desk has a left-handed orientation when the first work surface is oriented adjacent to the second platform support rails, and the desk has a reversed right-handed orientation when the second work surface is oriented adjacent to the second platform support rails.

13. The method of claim 12, further comprising coupling a first leg and a second leg of the plurality of leg assemblies to the first platform support rail to form the frame assembly.

14. The method of claim 13, further comprising coupling a drive shaft to a first height adjustment mechanism located within the first leg.

15. The method of claim 14, further comprising coupling the drive shaft to a second height adjustment mechanism located within the second leg before coupling the second leg to the first platform support rail.

16. The method of claim 15, further comprising:

coupling a crank assembly to an actuator shaft of the first height adjustment mechanism.

17. The method of claim 16, wherein reconfiguring the desk further includes:

decoupling the crank assembly from the actuator shaft of the first height adjustment mechanism; and coupling the crank assembly to an actuator shaft of the second height adjustment mechanism.

18. The method of claim 16, wherein coupling the crank assembly to the actuator shaft includes coupling a set collar to the crank assembly to secure the crank assembly to the actuator shaft.

19. The method of claim 12, wherein the plurality of leg assemblies includes a first leg assembly, a second leg assembly, and a corner leg assembly, the first leg assembly and the corner leg assembly interconnected with the first platform support rail, and the corner leg assembly and the second leg assembly interconnected with a third platform support rail; and wherein reconfiguring the desk further includes:

disconnecting the first platform support rail from the first leg assembly and the corner leg assembly;

disconnecting the third platform support rail from the corner leg assembly and the second leg assembly;

connecting the first platform support rail to the corner leg assembly and the second leg assembly; and connecting the third platform support rail to the first leg assembly and the corner leg assembly.

* * * * *

UNITED STATES PATENT AND TRADEMARK OFFICE

CERTIFICATE OF CORRECTION

PATENT NO. : 8,104,410 B2
APPLICATION NO. : 12/626341
DATED : January 31, 2012
INVENTOR(S) : R. B. Lanfear et al.

It is certified that error appears in the above-identified patent and that said Letters Patent is hereby corrected as shown below:

| COLUMN | LINE | ERROR |
|---|---|---|
| 10 (Claim 12 line 12) | 29 | "aliened" should read --aligned-- |

Signed and Sealed this
Sixth Day of November, 2012

David J. Kappos

David J. Kappos
*Director of the United States Patent and Trademark Office*